United States Patent [19]

Killion

[11] Patent Number: 5,050,575

[45] Date of Patent: Sep. 24, 1991

[54] DISK LAUNCHER

[76] Inventor: Darryl B. Killion, 236 E. Palm, Orange, Calif. 92666

[21] Appl. No.: 475,857

[22] Filed: Feb. 6, 1990

[51] Int. Cl.[5] ..... F41B 7/08

[52] U.S. Cl. ..... 124/8; 124/26; 124/49; 124/81

[58] Field of Search ..... 124/1, 4–8, 124/16, 27, 81, 26, 45, 47, 36

[56] References Cited

U.S. PATENT DOCUMENTS

| | | | |
|---|---|---|---|
| 66,048 | 6/1867 | Sherwood et al. | 124/26 |
| 488,827 | 12/1892 | Melius | 124/8 X |
| 756,988 | 4/1904 | Smith | 124/26 |
| 806,897 | 12/1905 | Kautzky | 124/46 X |
| 1,222,446 | 4/1917 | Napier et al. | 124/26 |
| 1,552,191 | 9/1925 | Bahlmann | 124/26 |
| 1,638,283 | 8/1927 | Bahlmann | 124/26 |
| 1,758,032 | 5/1930 | Dickman | 124/26 |
| 2,135,603 | 11/1938 | Roth | 124/8 |
| 3,322,108 | 5/1967 | Hoag | 124/47 X |
| 3,515,114 | 6/1970 | Carbonneau | 124/27 |
| 3,717,136 | 2/1973 | Gay et al. | 124/36 X |
| 4,059,089 | 11/1977 | Lehman | 124/27 |

FOREIGN PATENT DOCUMENTS

| | | | |
|---|---|---|---|
| 2038193 | 7/1980 | United Kingdom | 124/16 |

*Primary Examiner*—Peter M. Cuomo
*Assistant Examiner*—Jeffrey L. Thompson
*Attorney, Agent, or Firm*—Roy A. Ekstrand

[57] ABSTRACT

A disk launcher includes a generally cylindrical housing having a handle depending downwardly therefrom. The housing further defines an interior cavity within which a launching shuttle is pivotally movable under the urging of an internal power spring. An opening in the housing is provided through which a disk may be inserted. A trigger mechanism permits the swept launching member to be locked in a launching position in which the inserted disk is positioned for launch. As the trigger mechanism is released, the launcher sweeps through a pivotal motion and hurls the disk outwardly through an exit slot in the housing. A magazine apparatus is provided which provides for the serially launching of a succession of disk objects.

12 Claims, 3 Drawing Sheets

FIG. 1
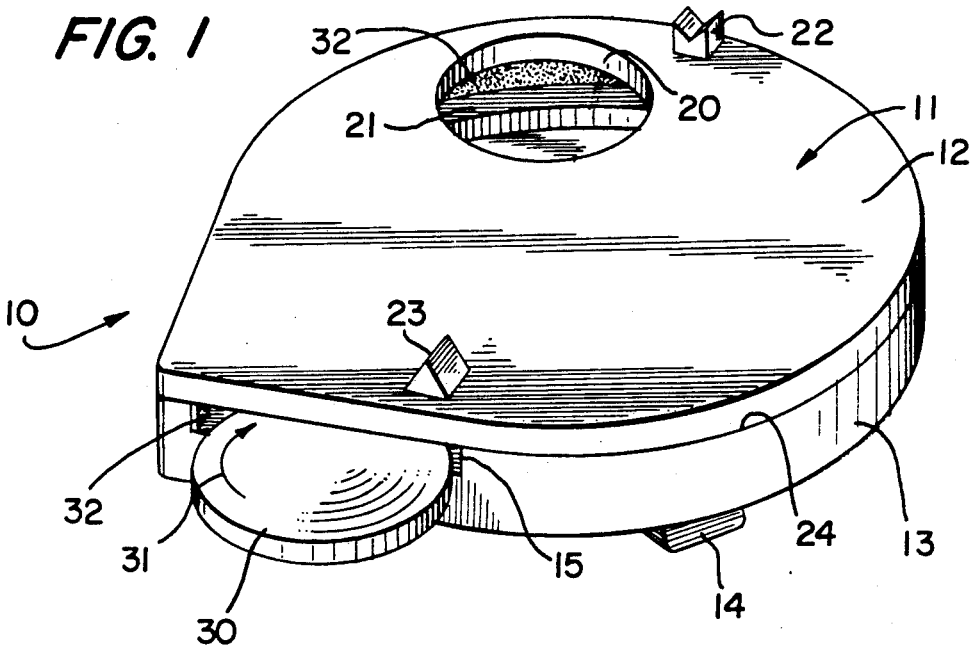
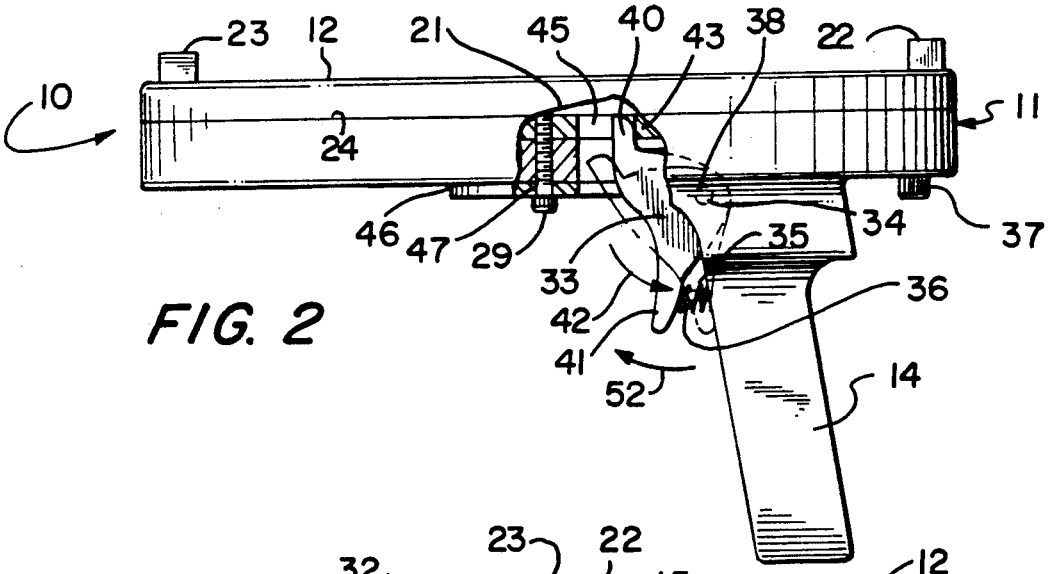
FIG. 2
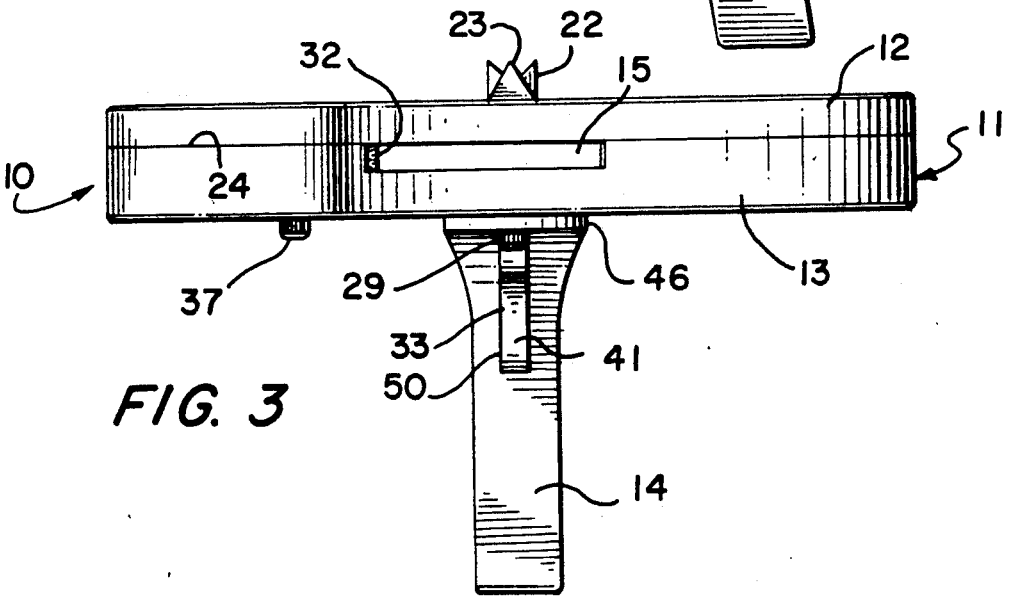
FIG. 3

DISK LAUNCHER

FIELD OF THE INVENTION

This invention relates generally to toy or sports activities and particularly to apparatus used in playing disk-type games or sports activities.

BACKGROUND OF THE INVENTION

A great many games and amusements have been conceived which employ a disk-like game object. Examples are found in activities and sports as diverse as the track and field activity known as discus throw and the popular sport of ice hockey. In addition, a great variety of games and amusements have resulted from the use of various air foil type disk objects. One of the most popular and pervasive air foil disk game object is that marketed under the trademark FRISBEE. Such disk game objects and air foil toys have been formed and created in a virtually endless variety. However, most common construction features of such disk game objects include a generally planar disk often formed in a domed or convex air foil having a surrounding downwardly rim or lip. In many disk game objects, the lip is further curved to enhance the air trapping and air foil characteristics of the object. While many activities may be carried forward for sport and amusement value employing such disk game objects, most commonly the disk objects are thrown in a motion which imparts an axial spin to the object. In most instances, the combination of velocity and spin as well as the air foil characteristics of the object result in a floating type glide path. In response to the unusual floating and gliding characteristics of such throwing disks, a variety of games involving throwing and catching of such game objects evolve.

While the foregoing described disk game elements have provided a great many interesting and enjoyable game and sports activities, there remains a continuing need in the art for improved sport amusement and game apparatus.

SUMMARY OF THE INVENTION

Accordingly, it is a general object of the present invention to provide an improved sport amusement or game object which utilizes a disk-like game device.

In accordance with the present invention, there is provided for use in launching a disk-shaped object, a disk launcher comprises: a housing having an interior cavity and exit slot defined therein; a pivotable shuttle member; pivot means pivotably supporting the shuttle member within the interior cavity; spring means coupled to the shuttle member urging it in a first pivotal direction; trigger means for releasably locking the shuttle member in a cocked position opposed by the spring means; and loading means for positioning a disk-shaped game object proximate the shuttle member when in the cocked position, the trigger means being operable to release the shuttle member from the cocked position whereby the shuttle member is rapidly pivoted in the first direction by the spring means to launch the disk-shaped objection through the slot.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 sets forth a perspective view of a disk launcher constructed in accordance with the present invention;

FIG. 2 sets forth a partially sectioned elevation of the present invention disk launcher;

FIG. 3 sets forth a front elevation view of a disk launcher constructed in accordance with the present invention;

BRIEF DESCRIPTION OF THE PREFERRED EMBODIMENTS

Figure 4:
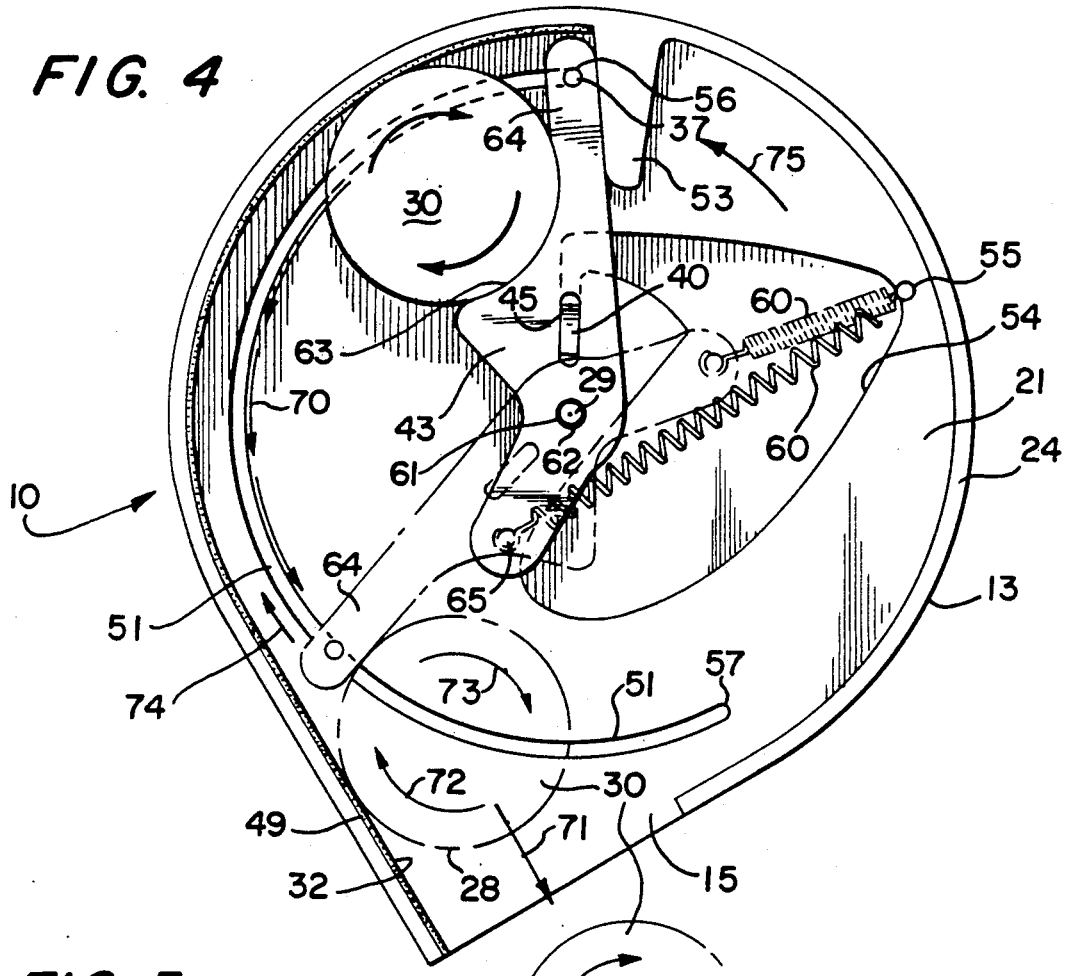
FIG. 4 sets forth a top view of the present invention disk launcher having the top portion of the housing removed.

FIG. 1 sets forth a perspective view of a disk launcher constructed in accordance with the present invention and generally referenced by numeral 10. Disk launcher 10 includes a housing 11 having a generally planar top cover 12. Top cover 12 in turn defines a circular aperture 20 and supports a front sight 23 and rear sight 22. Housing 11 further includes a base 13 having an upwardly extending edge 24 and an elongated exit slot 15. Top cover 12 is supported upon edge 24 and provides partial enclosure of base 13 to define a housing interior cavity 21. Top cover 12 provides an upper surface to complete the enclosure of exit slot 15. A handle 14 described below in greater detail extends downwardly from base 13 as described below. A gripping surface 32 extends inwardly from exit slot 15. A generally circular disk 30 is received within interior cavity 21 via aperture 20. In accordance with the apparatus set forth below, disk 30 rests within interior cavity 21 and is launched along gripping surface 32 to exit at slot 15 in accordance with the structure set forth below in greater detail. It should be noted that, in accordance with an important aspect of the present invention and as is set forth in more detail below, disk 30 is forced against gripping surface 32 during the launch of disk 30 imparting a spin motion to disk 30 in the direction indicated by arrow 31. While the operation of launcher 10 is set forth below in greater detail, suffice it to note here that the user grips handle 14 (better seen in FIG. 2) and deposits disk 30 into interior cavity 21 via aperture 20. Thereafter, the launching means set forth below are triggered causing disk 30 to be accelerated through interior cavity 21 along gripping surface 32 and launched from exit slot 15 with a substantial velocity. During such launch, the alignment of front sight 23 and rear sight 22 by the user facilitates the directing or aiming of the flight path of disk 30.

FIG. 2 sets forth a partially sectioned side elevation view of disk launcher 10. As set forth above, launcher 10 includes a base 13 having an upwardly extending edge 24 and defining an interior cavity 21. A top cover 12 comprising a generally planar member is joined to edge 24 and supports a front sight 23 and a rear sight 22. A handle 14 forms a generally inclined pistol grip-type handle having a handle flange 46 extending outwardly therefrom. Handle 14 further defines an inwardly extending trigger channel 50 (seen in FIG. 3). A fastener 29 extends through an aperture 47 defined in flange 46 to secure handle 14 to the underside of base 13. As is set forth below in greater detail, an elongated shuttle arm 43 (seen in FIG. 4) is pivotally secured to fastener 29 within interior cavity 21. Shuttle arm 43 includes a trigger slot 45 and a downwardly extending knob 37. As is better seen in FIG. 4, base 13 defines a circular arc-shaped slot concentric with fastener 29. In accordance with the invention, knob 37 extends through circular slot 51 in base 13 and is secured to shuttle arm 43. Knob 37 functions to provide a convenient handle by which shuttle arm 43 may be pivoted to the cocked or armed position in preparation for launching a circular disk such as disk 30. Thus in the position shown in FIG. 2, knob 37 has been pulled rearwardly through slot 51 (seen in FIG. 4) to permit disk 30 to be received within interior cavity 21 of housing 11.

A trigger lever 33 defines a generally triangular-shaped member having an aperture 38 received within trigger channel 50. A pivot pin 34 extends through aperture 38 and pivotally secures trigger lever 33 within trigger channel 50. Trigger lever 33 defines an upwardly extending tab 40 and a downwardly extending trigger grip 41. Trigger lever 33 further defines a generally cylindrical spring guide 36 extending toward handle 14. A coil spring 35 is received upon spring guide 36 and is compressively captivated between handle 14 and trigger grip 41 of trigger lever 33. Spring 35 provides a spring force which urges trigger grip 41 outwardly from handle 14 in the direction indicated by arrow 52. The force of spring 35 urges trigger lever 33 in a pivotal motion in which tab 40 is forced upwardly.

Thus with knob 37 pulled to the rear portion of base 13 in the cocked position shown in FIG. 2, trigger slot 45 in shuttle arm 43 is brought into alignment with tab 40. The alignment of slot 45 permits tab 40 to be forced upwardly to the position shown in FIG. 2 which in turn provides a locking action upon shuttle arm 43 against base 13. Thereafter, once trigger lever 33 has pivoted to the position shown in solid line representation in FIG. 2, knob 37 may be released and shuttle arm 43 is retained in the cocked position. With temporary reference to FIG. 4, it should be noted that an elongated power spring 60 is operative upon shuttle arm 43 which provides the launching force for disk 30. Thus with disk 30 in place beneath aperture 20 and shuttle arm 43 in the cocked position due to the locking action of trigger lever 33, disk 30 may be launched by depressing trigger grip 41 in the direction indicated by arrow 42 with sufficient force to overcome spring 35 and pivot trigger lever 33 about pivot pin 34. As trigger grip 41 is depressed in the direction indicated by arrow 42, lever 33 assumes the triggered position shown in dashed line representation in FIG. 2. In accordance with the invention, the pivotal motion of lever 33 removes tab 40 from trigger slot 45 of shuttle arm 43 which in turn releases shuttle arm 43 permitting spring 60 to sweep shuttle arm 43 in the manner described below through an arced motion which in turn launches disk 30 outwardly through exit slot 15 (the latter seen in FIG. 1).

In operation, launcher 10 is armed or cocked by pulling knob 37 rearwardly to the position shown in FIG. 2 while simultaneously releasing trigger grip 41. Spring 35 pivots trigger lever 33 in a clockwise direction about pivot pin 34 until tab 40 is captivated within trigger slot 45 of shuttle arm 43. Thereafter, a to-be-launched disk such as disk 30 is placed within interior cavity 21 of housing 11 through aperture 20 (seen in FIG. 1). Thereafter, disk 30 is launched by depressing trigger grip 41 to once again rotate trigger lever 33 in the direction of arrow 42 which in turn releases shuttle arm 43 and permits power spring 60 to sweep shuttle arm 43 in a rapid pivoal motion and launch disk 30 outwardly through exit slot 15. By means set forth below in greater detail, it should be noted from examination of FIG. 1 that disk 30 emerges from exit slot 15 after having been driven along gripping surface 32. Accordingly and in accordance with an important aspect of the present invention, a spinning motion is imparted to disk 30 in the direction indicated by arrow 31 as it is launched through exit slot 15.

FIG. 3 sets forth a front elevation view of disk launcher 10. As described above, disk launcher 10 includes a housing 11 having a generally planar top cover 12 and a base member 13. Base member 13 defines an elongated exit slot 15 and supports a curved gripping surface 32. Top cover 12 defines an aperture 20 (seen in FIG. 1) and supports a front sight 23 and a rear sight 22. A handle 14 extends downwardly from the underside of base 13 and defines a handle flange 46 and an internal trigger channel 50. A fastener 29 extends upwardly through an aperture 47 (seen in FIG. 2) in flange 46 and is received within base 13. A generally triangular trigger lever 33 is pivotally secured within trigger channel 50 in the manner set forth above. Trigger lever 33 includes a downwardly extending trigger grip 41 and an upwardly extending tab 40 (seen in FIG. 2).

FIG. 4 sets forth a top view of disk launcher 10 having top cover 12 removed to provide a clearer view of the operation of disk launcher 10. Disk launcher 10 includes a base 13 defining an interior cavity 21 in an upwardly extending edge 24. Base 13 further defines a spring recess 54 and an upwardly extending limit stop 53. Base 13 also defines a circular curved slot 51 and an elongated exit slot 15. An elongated shuttle arm 43 defines a straight edge 64 and a curved disk bay 63. Shuttle arm 43 defines an aperture 61 and an aperture 56. Aperture 56 receives knob 37 extending upwardly through curved slot 51 in base 13. Fastener 29 extends upwardly through base 13 in the manner described below and through aperture 61 in shuttle arm 43. A bearing 62 is received within aperture 61 of shuttle arm 43 and upon fastener 29. Shuttle arm 43 further includes an upwardly extending spring post 65 and an elongated trigger slot 45. Thus, shuttle arm 43 is pivotable about fastener 29 through a pivotal motion which is limited in the clockwise direction by limit stop 53 and limited in the counterclockwise direction by the interference of knob 37 and end 57 of curved slot 51. An elongated coiled power spring 60 is coupled between post 55 on base 13 and post 65 on shuttle arm 43. Power spring 60 comprises a tension spring which is operative to draw post 65 on shuttle arm 43 toward post 55 on base 13. Thus, the dashed line representation of shuttle arm 43 in FIG. 4 depicts the position of shuttle arm 43 corresponding to that toward which power spring 60 urges the shuttle arm. In other words, the dashed line representation shown in FIG. 4 depicts shuttle arm 43 in its most relaxed or neutral position.

In operation with shuttle arm 43 initially positioned as shown in the dashed line representation in FIG. 4, knob 37 is drawn toward limit stop 53 in the direction indicated by arrow 74 which in turn pivots shuttle arm 43 about fastener 29. Because the pivotal motion of shuttle arm 43 in the direction indicated by arrow 74 is opposed by the force of power spring 60, sufficient force must be exerted against knob 37 to overcome power spring 60 and stretch the spring. The pivotal motion of shuttle arm 43 is continued until arm 43 contacts limit stop 53 which in turn aligns trigger slot 45 of arm 43 with tab 40 of trigger lever 33. In accordance with the operation of trigger lever 33 set forth below, tab 40 is received within trigger slot 45. Thereafter, knob 37 is released and shuttle arm 43 assumes the cocked position shown in solid line representation in FIG. 4. It should be noted that in the cocked position power spring 60 is stretched to its maximum length and provides a substantial force upon shuttle arm 43 urging it in the direction indicated by arrow 75. Thereafter, with shuttle arm 43 in the cocked position, a disk 30 is inserted through aperture 20 in top cover 12 (seen in FIG. 1) such that disk 30 settles into interior cavity 21 of base 13 and rests within disk bay 63 of shuttle arm 43. At this point disk launcher 10 is completely prepared to launch disk 30. Thereafter, disk 30 is launched by simply pulling trigger grip 41 (seen in FIG. 2) to withdraw tab 40 from trigger slot 45 in shuttle arm 43. Once tab 40 is removed from slot 45, the force of power spring 60 pivots shuttle arm 43 rapidly in the direction indicated by arrow 75. The sweeping motion of shuttle arm 43 caused by power spring 60 in turn hurls disk 30 against gripping surface 32 of base 13. As arm 43 is swept through its pivotal motion, disk 30 is hurled along gripping surface 32 and outwardly through exit slot 15. The rapid motion of shuttle arm 43 also causes disk 30 to roll upon gripping surface 32 which imparts a rapid spin to disk 30 in the direction indicated by arrows 72 and 73. As shuttle arm 43 reaches the position shown in dashed line representation in FIG. 4, gripping surface 32 transitions from a curved surface to a straight surface and launches disk 30 outwardly through exit slot 15. Thereafter, the sweeping motion of shuttle arm 43 continues until knob 37 encounters end 57 of slot 51. In accordance with an important aspect of the present invention, however, the rotation of shuttle arm 43 past the dashed line position shown in FIG. 4 begins a second extension of power spring 60. Thus, power spring 60 is operative to provide an accelerating force as shuttle arm 43 is released and a decelerating force as shuttle arm 43 approaches end 57 of curved slot 51. Thereafter, the drawing force of power spring 60 returns shuttle arm 43 to the neutral position shown in dashed line representation in FIG. 4 permitting the cycle to be repeated and an additional disk to be launched.

The foregoing described embodiment of the present invention generally referenced in FIGS. 1 through 4 as disk launcher 10 is configured to a provide a "single shot" operation of the disk launcher in that successive disks to be launched must be individually deposited through aperture 20 prior to launching. While the above-described single shot disk launcher provides substantial enjoyment and amusement value, it is often desired to provide a multiple shot-type operation for the present invention disk launcher.

Figure 5:
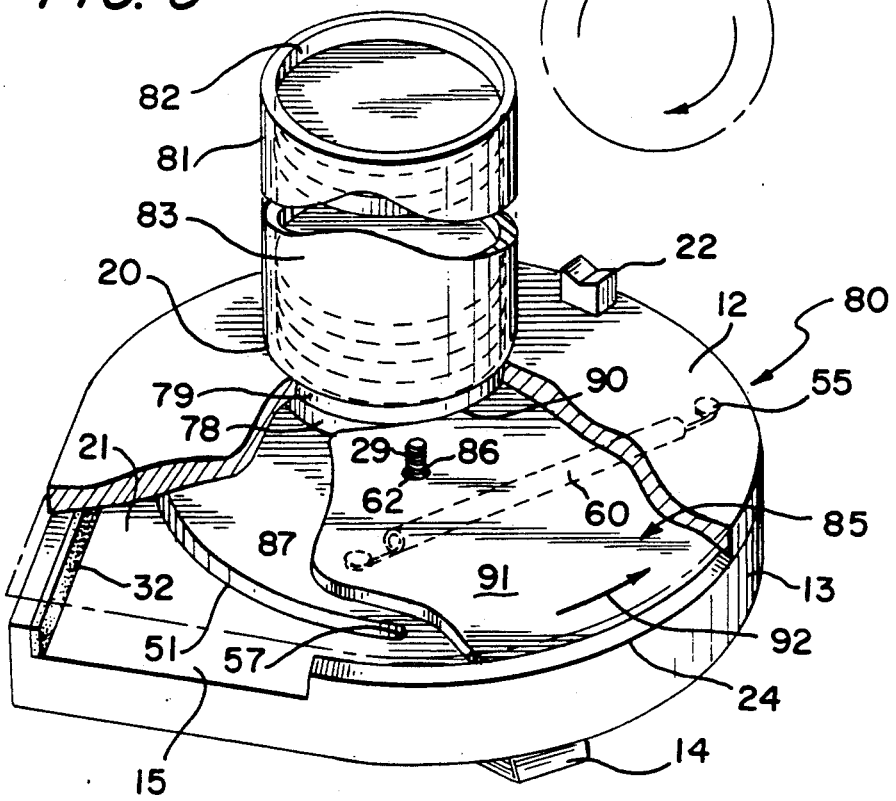
FIG. 5 sets forth a perspective view of an alternate embodiment of the present invention disk launcher.

Accordingly, FIG. 5 sets forth a perspective view of an alternate embodiment of the present invention disk launcher which facilitates a repeating action and which is generally referenced by numeral 80. Disk launcher 80 includes base 13, handle 14 and the above-described trigger mechanism in accordance with the embodiment shown in FIGS. 1 through 4. In further accordance with the above-described embodiment, base 13 defines an upwardly extending edge 24, a gripping surface 32 and an exit slot 15. Base 13 further defines a curved slot 51 having an end 57. In further similarity to the above-described single shot embodiment shown in FIGS. 1 through 4, disk launcher 80 further includes a top cover 12 which defines a circular aperture 20 and supports a rear sight 22 and a front sight 23 (not seen in FIG. 5). Disk launcher 80 differs from disk launcher 10 described above in that a disk magazine 81 comprising a generally cylindrical member is secured to top cover 12 overlying aperture 20. Disk magazine 81 defines an internal cylindrical passage 82 having a diameter corresponding to disks 83 and aligned with aperture 20. Disk launcher 80 further differs from disk launcher 10 in that a generally planar shuttle 85 is utilized in place of shuttle arm 43. Accordingly, shuttle 85 comprises a planar member having a multiply curved shaped and defining an aperture 86. Fastener 29 extends upwardly through aperture 86 and receives a bearing 62. As is better seen in FIG. 6, shuttle 85 defines a curved outer edge 95 which comprises a continuous arc concentric with aperture 86 and a circular disk bay 90. Shuttle 85 further includes a post 87. Thus, shuttle 85 is pivotable within base 13 about fastener 29 in the same manner as described above for shuttle arm 43. Power spring 60 is coupled between post 55 of base 13 and post 87 of shuttle 85. Power spring 60 is operative to urge shuttle 85 in a pivotal motion about fastener 29 in the direction indicated by arrow 92. The operation of shuttle 85 is set forth below in greater detail in connection with FIG. 6. However, suffice it to here that shuttle 85 is depicted in FIG. 5 in the cocked position in preparation for the launch of a disk. Accordingly, disk 78 is received within interior cavity 21 of base 13 and is resting against disk bay 90 of shuttle 85. Thus upon release of the above-described trigger mechanism, power spring 60 is operative to rapidly pivot shuttle 85 in the direction indicated by arrow 92 which in turn launches disk 78 outwardly through slot 15 in the same manner described above for the operation of shuttle arm 43. It should be noted, however, that in the position shown while disk 78 is received within disk bay 90, disk 79 rests upon disk 78 and is positioned within aperture 20 in top cover 12. In addition, the remaining disks in disk stack 83 within passage 82 rests upon disk 79. In accordance with an important aspect of the present invention as shuttle 85 is pivoted about fastener 29 to launch disk 78, disk bay 90 passes beneath disk 79 causing disk 79 to rest upon surface 91 and remain within aperture 20. Thus as disk 78 is launched, the next disk within the stack, that is disk 79, is precluded from dropping through aperture 20 into interior cavity 21. In accordance with an important aspect of the present invention, surface 91 continues to support disk 79 during the entire rotational launching cycle of shuttle 85. As a result, disk 79 is maintained within aperture 20. Once disk 78 is launched, shuttle 85 is returned to the cocked position by drawing knob 37 rearwardly through curved slot 51 in the manner described above and re-engaging the above-described trigger to maintain shuttle 85 in the cocked position. As shuttle 85 is returned to the cocked position shown in FIG. 5, disk bay 90 is once again aligned with aperture 20 in top cover 12 which permits disk 79 to descend downwardly into internal cavity 21 and assume the loaded position shown for disk 78. This cycle is repeated as successive disks are launched and succeeding disks are supported upon surface 91 of shuttle 85 to facilitate a repeating action in which a succession of disks may be launched from disk launcher 80 by simply manipulating knob 37 to cocked shuttle 85.

Figure 6:
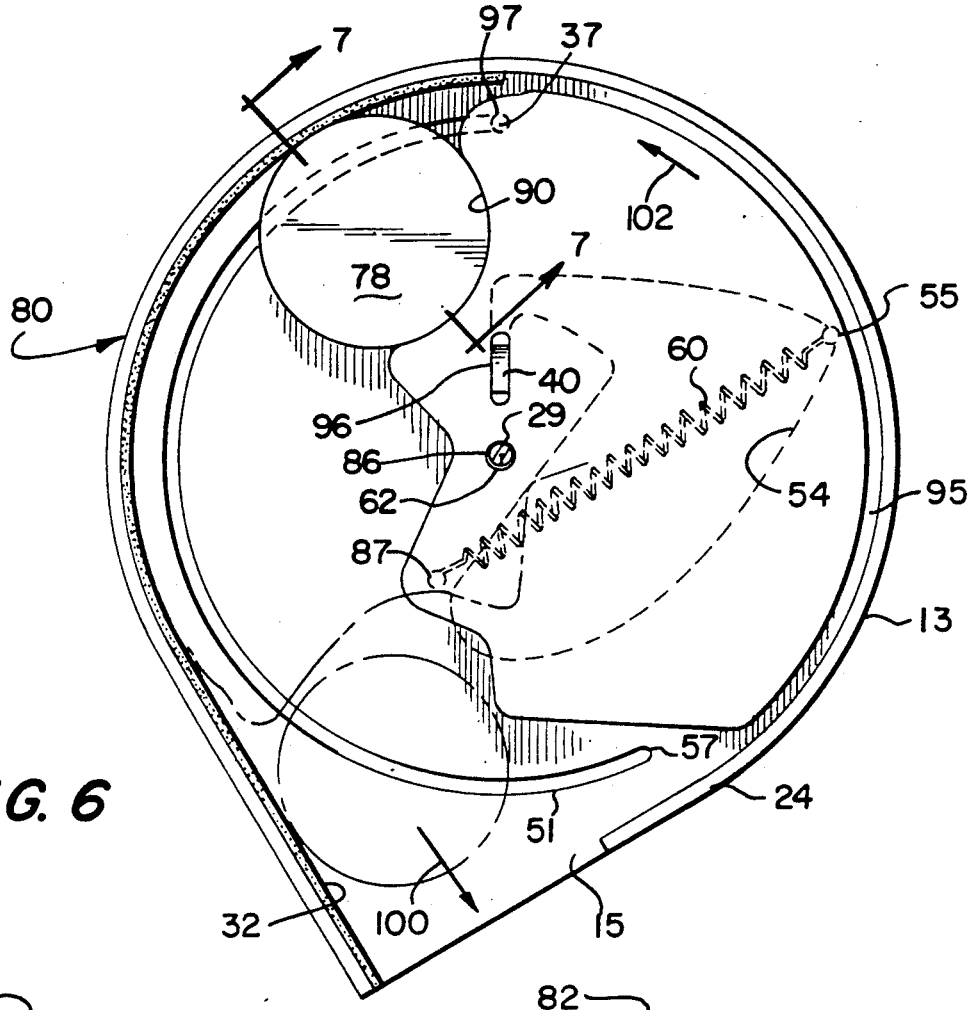
FIG. 6 sets forth a top view of the alternate embodiment of the present invention disk launcher shown in FIG. 5 having the top portion of the housing thereof removed.

FIG. 6 sets forth a top view of disk launcher 80 having top cover 12 and disk magazine 81 removed. Accordingly, disk launcher 80 includes a base 13 having an internal cavity 21 defined therein. Base 13 further includes an upwardly extending edge 24 and an elongated slot 15. Base 13 further includes a curved slot 51 having ends 57 and 58. A gripping surface 32 is supported upon the interior of edge 24. Base 13 supports a spring post 55 and defines a spring recess 54. A generally planar shuttle 85 defines a multiply curved inner surface and a arc-shaped outer edge 95. Edge 95 defines a circular arc concentric with aperture 86. Shuttle 85 further defines an aperture 86 and an elongated trigger slot 96. A fastener 29 extends upwardly through base 13 and aperture 86 and supports a bearing 62. A post 87 is secured to the under surface of shuttle 85. A power spring 60 is coupled between post 87 and post 55 to urge pivotal motion of shuttle 85 in the direction indicated by arrow 102.

In the position shown in FIG. 6, shuttle 85 is positioned in the cocked or loaded position in which spring 60 urges shuttle 85 to pivot about fastener 29 in the direction indicated by arrow 102 and in which tab 40 extends into trigger slot 96 to preclude pivotal motion of shuttle 85. As described above, a disk 78 is positioned within disk bay 90 of shuttle 85. Thus as trigger grip 41 (seen in FIG. 2) is squeezed against handle 14, tab 40 is withdrawn from trigger slot 96 which in turn permits spring 60 to sweep shuttle 85 in the direction indicated by arrow 102 which produces the above-described launching of disk 78 outwardly through slot 15 in the direction indicated by arrow 100. As described above and as will be apparent from examination of FIG. 6, shuttle 85 is configured to provide a planar surface 91 which supports disk 79 and the remainder of disk stack 83 within passage 82 of disk magazine 81 (seen in FIG. 5) during the entire launching motion of shuttle 85. Thus as described above as each disk within the disk magazine is launched, the succeeding disks are supported by surface 91 of shuttle 85. Once shuttle 85 has launched disk 78, it is simply returned to the cocked position shown in FIG. 6 by drawing knob 37 to end 58 of slot 51 and releasing tab 40 into trigger slot 96. When so positioned, shuttle 85 permits the next succeeding disk to drop into launching position of disk bay 90. Comparison of FIGS. 4 and 6 shows that base 13 has been altered in FIG. 6 to facilitate the use of a planar shuttle 85 in place of shuttle arm 43 in that limit stop 53 has been removed. Limit stop 53 is removed to avoid interference with shuttle 85. In addition, the cooperation of knob 37 and end 58 of slot 51 provide the limit stop function previously provided by limit stop 53.

Figure 7:
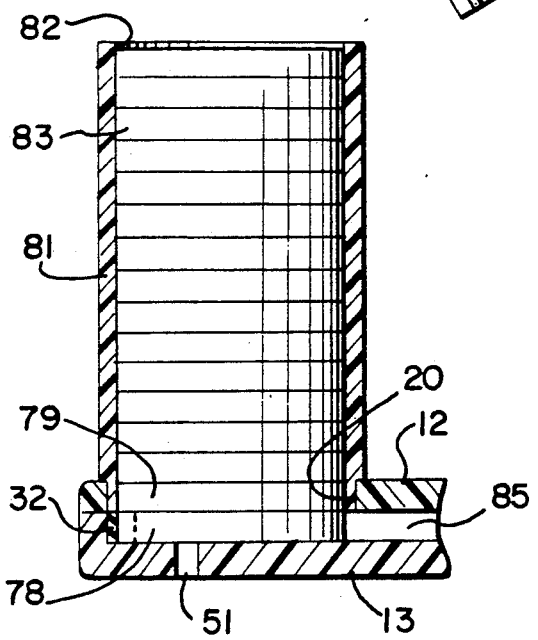
FIG. 7 sets forth a section view of the present invention disk launcher taken along section lines 7—7 in FIG. 6.
Figure 8:
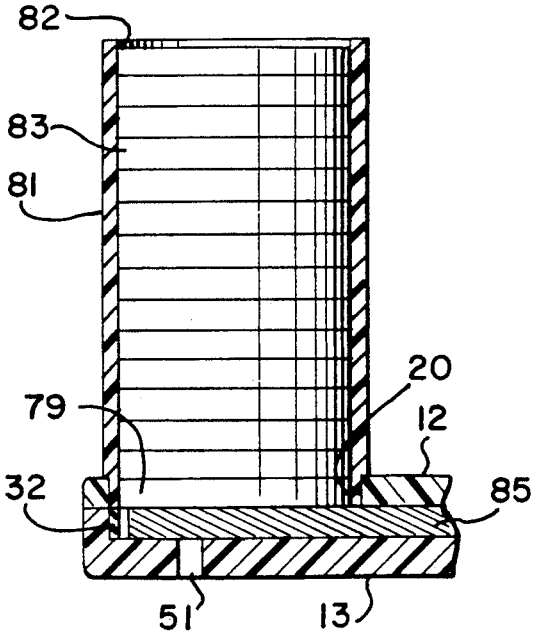
FIG. 8 sets forth a section view of the present invention disk launcher taken along section lines 7—7 in FIG. 6 following the launch of a disk object.

FIGS. 7 and 8 set forth the operation of the above-described magazines in a pair of section views taken along section lines 7—7 in FIG. 6. Thus, with simultaneous reference to FIGS. 7 and 8, base 13 and top cover 12 support a generally cylindrical disk magazine 81. Disk magazine 81 defines an interior passage 82 and supports a plurality of disks 83. In the position shown in FIG. 7, shuttle 85 is positioned in the cocked position prior to launching and disk 78 is positioned within disk bay 90 (seen in FIG. 6) of shuttle 85. In FIG. 7, disk 79 is supported by disk 78 and the remaining disks in disk stack 83 are supported by disk 79.

FIG. 8 depicts the sectional view of FIG. 7 subsequent to the launching of disk 78. As can be seen, shuttle 85 now occupies the region beneath disk 79 and precludes disk 79 from falling into base 13. Thus, disk 79 and disk stack 83 are supported upon surface 91 of shuttle 85. When shuttle 85 is returned to the cocked position shown in FIG. 6, surface 91 of shuttle 85 will no longer support disk 79 and, as a result, disk 79 will move downwardly to occupy the loaded position shown for disk 78 in FIG. 7.

What has been shown is a novel disk launcher which provides substantial entertainment, sports and amusement value in its capability to launch one or more disk-like game objects in a spinning fashion and with a substantial degree of accuracy. It will be apparent to those skilled in the art that the present invention disk launcher may be utilized to provide a great variety of game and amusement activities as well as several sports activities. In one of the more likely anticipated uses of the present invention disk launcher, the launcher will assume the position occupied by a pitcher in baseball and launch a disk toward an opposing player having a suitably configured bat who will attempt to hit the launched disk in much the same manner as a baseball is hit. It will be apparent that a game similar to baseball may be carried forward using the present invention launcher. Thus, it will be apparent to those skilled in the art that a variety of game and sports activities may be devised which make use of the unique qualities of the present invention disk launcher.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. For use in launching a disk-shaped object, a disk launcher comprising:

a housing having an interior cavity, an arced travel path defining an outer arced gripping surface for causing said disk-shaped object to roll against said gripping surface, and exit slot defined therein;

a pivotable shuttle member having a curved portion generally corresponding to the curvature of the disk-shaped object;

pivot means supporting said shuttle member within said interior cavity in a freely pivotable attachment;

spring means separate from said shuttle member and operatively coupled to said shuttle member urging it in a first pivotal direction;

trigger means for releasably locking said shuttle member in a cocked position opposed by said spring means; and loading means for positioning a disk-shaped game object proximate said shuttle member when in said cocked position, said trigger means being operable to release said shuttle member from said cocked position whereby said shuttle member is rapidly pivoted in said first direction by said spring means to move said disk-shaped member along said arced travel path within said housing and force it against said gripping surface and to launch said disk-shaped object through said slot having spin motion as it is launched.

2. A disk launcher as set forth in claim 1 wherein said housing includes a handle.

3. A disk launcher as set forth in claim 2 wherein said housing includes a generally flat hollow member having an upper surface, a lower surface and a side wall enclosing said interior cavity.

4. A disk launcher as set forth in claim 3 wherein said shuttle member defines an aperture and wherein said pivot means include a pivot member received within said aperture.

5. A disk launcher as set forth in claim 4 wherein said shuttle member defines a trigger slot and wherein said trigger means include a movable tab movable to and from said trigger slot.

6. A disk launcher as set forth in claim 5 wherein loading means include an opening defined in said upper surface of said housing.

7. A disk launcher as set forth in claim 6 wherein said shuttle member defines an elongated member having a first end for contacting a disk-shaped object and a second end coupled to said spring means.

8. A disk launcher as set forth in claim 6 wherein said shuttle member defines a planar member having a surface underlying said opening in said housing upper surface in all positions except said cocked position and wherein said loading means include a magazine having a passage for supporting a plurality of disk-shaped objects above said opening.

9. A disk launcher as set forth in claim 1 wherein said housing includes a curved surface having an arc portion having its center of radius of curvature coincident with the pivotal motion center of said shuttle member and wherein said curved portion of said shuttle member captivates the disk-shaped object in said cocked position.

10. A disk launcher as set forth in claim 9 wherein said curved surface supports a layer of rubber material forming said gripping surface for causing the disk-shaped object to spin as it is launched.

11. For use in launching a disk-shaped object in a spinning flight, a disk launcher comprising:

a housing having an interior cavity, an arced travel path defining an outer arced gripping surface for causing said disk-shaped object to roll against said gripping surface, and exit slot defined therein;

a pivotable shuttle member having a surface for thrusting said disk-shaped object outwardly when moved toward said exit slot;

pivot means pivotably supporting said shuttle member within said interior cavity;

spring means coupled to said shuttle member urging it in a first pivotal direction;

trigger means for releasably locking said shuttle member in a cocked position opposed by said spring means; and loading means for positioning a disk-shaped game object in direct contact with said shuttle member when in said cocked position, said trigger means being operable to release said shuttle member from said cocked position whereby said shuttle member is rapidly pivoted in said first direction by said spring means to force said disk-shaped object against said gripping surface causing said disk-shaped object to be launched through said slot having a spinning motion imparted thereto.

12. For use in launching a disk-shaped object, a disk launcher comprising:

a housing having a handle, an interior cavity, a generally flat hollow member having an upper surface, a lower surface and a side wall enclosing said interior cavity, an exit slot defined therein and a gripping surface for causing the disk-shaped object to spin as it is launched, a pivotable shuttle member defining an elongated member having a first end for contacting a disk-shaped object and second end and having a trigger slot, an aperture and a curved portion generally corresponding to the curvature of the disk-shaped object;

pivot means having a pivot member received within said aperture in said shuttle member for supporting said shuttle member within said interior cavity in a freely pivotable attachment;

spring means separate from said shuttle member and operatively coupled to said second end of said shuttle member urging it in a first pivotal direction;

trigger means having a movable tab movable to and from said trigger slot for releasably locking said shuttle member in a cocked position opposed by said spring means; and loading means including an opening defined in said upper surface of said housing for positioning a disk-shaped game object proximate said shuttle member when in said cocked position, said trigger means being operable to release said shuttle member from said cocked position whereby said shuttle member is rapidly pivoted in said first direction by said spring means to launch said disk-shaped object through said slot.

* * * * *